US006033735A

United States Patent [19]

Ederyd et al.

[11] Patent Number: 6,033,735

[45] Date of Patent: Mar. 7, 2000

[54] METHOD OF COATING CUTTING INSERTS

[75] Inventors: Stefan Ederyd, Saltsjö-Boo, Sweden; Enrico Galli, Kokkedal, Denmark; Mats Nygren, Bromma, Sweden; Gunnar Westin, Stockholm, Sweden; Asa Ekstrand, Hässelby, Sweden

[73] Assignee: Sandvik AB, Sandviken, Sweden

[21] Appl. No.: 08/849,770

[22] PCT Filed: Dec. 27, 1995

[86] PCT No.: PCT/SE95/01586

§ 371 Date: Sep. 18, 1997

§ 102(e) Date: Sep. 18, 1997

[87] PCT Pub. No.: WO96/21051

PCT Pub. Date: Jul. 11, 1996

[30] Foreign Application Priority Data

Dec. 30, 1994 [SE] Sweden ..... 9404588

[51] Int. Cl.[7] ..... B05D 3/02; B05D 3/04

[52] U.S. Cl. ..... 427/380; 427/383.1; 427/383.3; 427/383.5; 427/377

[58] Field of Search ..... 427/376.1, 377, 427/380, 383.1, 383.5, 383.3, 427, 430.1, 443.1

[56] References Cited

U.S. PATENT DOCUMENTS

| | | | |
|---|---|---|---|
| 3,011,920 | 12/1961 | Shipley, Jr. | 117/213 |
| 3,620,834 | 11/1971 | Duffy | 117/213 |
| 3,915,665 | 10/1975 | Kalish | 29/195 |
| 3,947,616 | 3/1976 | Ritsko et al. | 427/430.1 |
| 4,072,781 | 2/1978 | Shirahata et al. | 428/336 |
| 4,907,665 | 3/1990 | Kar et al. | 175/410 |
| 4,914,813 | 4/1990 | Layher et al. | 29/843 |
| 5,134,039 | 7/1992 | Alexander et al. | 428/614 |

OTHER PUBLICATIONS

Umehara et al., "Electroless plating method", 58–104169, Japanese patent abstracts, abstract, Jun. 21, 1983.

Chemical Abstracts, vol. 121, No. 10, Sep. 5, 1994, (Columbus, Ohio, USA), p. 438, The Abstract No. 115335x,JP, 649651,A, (Nippon Aluminum Mfg) Feb. 22, 1994.

Patent Abstracts of Japan, vol. 8, No. 99, E–243, abstract of JP,A,59–17223 (Nippon Denki K.K.), Jan. 28, 1984.

Patent Abstracts of Japan, vol. 13, No. 501, C–652, abstract of JP,A,1–201091 (Ibiden Co Ltd), Aug. 14, 1989.

*Primary Examiner*—Shrive Beck
*Assistant Examiner*—Michael Barr
*Attorney, Agent, or Firm*—Burns, Doane, Swecker & Mathis, L.L.P.

[57] ABSTRACT

There is disclosed a method of coating cemented carbide inserts at least partly with a layer of at least one iron group metal. When inserts coated with such a layer are brazed to a tool holder, a joint with improved strength is obtained. According to the present method, one or more metal salts of at least one iron group metal containing organic groups are dissolved and complex bound in at least one polar solvent with at least one complex former comprising functional groups in the form of OH or $NR_3$ (R=H or alkyl). A soluble carbon source is added to the solution which is subsequently at least partly applied to the cemented carbide inserts by dipping, spraying or painting. The inserts are dried and heat treated in an inert and/or reducing atmosphere. As a result, cemented carbide inserts are obtained at least partly coated with a layer of an iron group metal.

41 Claims, 1 Drawing Sheet

METHOD OF COATING CUTTING INSERTS

BACKGROUND OF THE INVENTION

The present invention relates to a method of coating cutting tool inserts with a layer of an iron group metal. Inserts with a coating applied according to the invention are particularly suitable for brazing.

Cemented carbide inserts are generally attached to toolholders by mechanical means if possible. In case of sawblades, drills and circular cutters, the design does not permit mechanical clamps and/or similar mechanical attachments. In these cases the inserts have to be brazed to the toolholder.

When brazing cemented carbide with a low binder content there are problems with the wetting of the braze and therefore the inserts have to be coated with cobalt prior to the brazing procedure. For coating on industrial scale, this cobalt coating is generally made electrolytically. However, such coating generally has poor adherence. In order to improve the adhesion, the inserts are heat treated in a subsequent production step. This coating method is rather complex and expensive and the resultant coating adhesion is still not always satisfactory.

OBJECTS AND SUMMARY OF THE INVENTION

It is an object of this invention to avoid or alleviate the problems of the prior art.

It is further an object of this invention to provide a method of coating cutting tool inserts with a layer of an iron group metal.

It is an aspect of the invention to provide a method of coating metal composite bodies formed of carbides, nitrides, carbonitrides with a binder phase of Co and/or Ni at least partly with a layer of at least one iron group metal comprising the following steps:

- dissolving and complex binding at least one salt of at least one iron group metal containing organic groups in at least one polar solvent with at least one complex former comprising functional groups of OH or $NR_3$, where R=H or alkyl;
- optionally adding a soluble carbon source and/or other soluble agents to improve the wetting properties into the solution;
- applying the solution at least partly on said bodies by dipping, spraying or painting;
- drying the bodies to evaporate the solvent; and
- heat treating the dried bodies in inert and/or reducing atmosphere to obtain said bodies at least partly coated with said at least one iron group metal.

DETAILED DESCRIPTION OF THE PREFERRED EMBODIMENTS OF THE INVENTION

Figure 1:
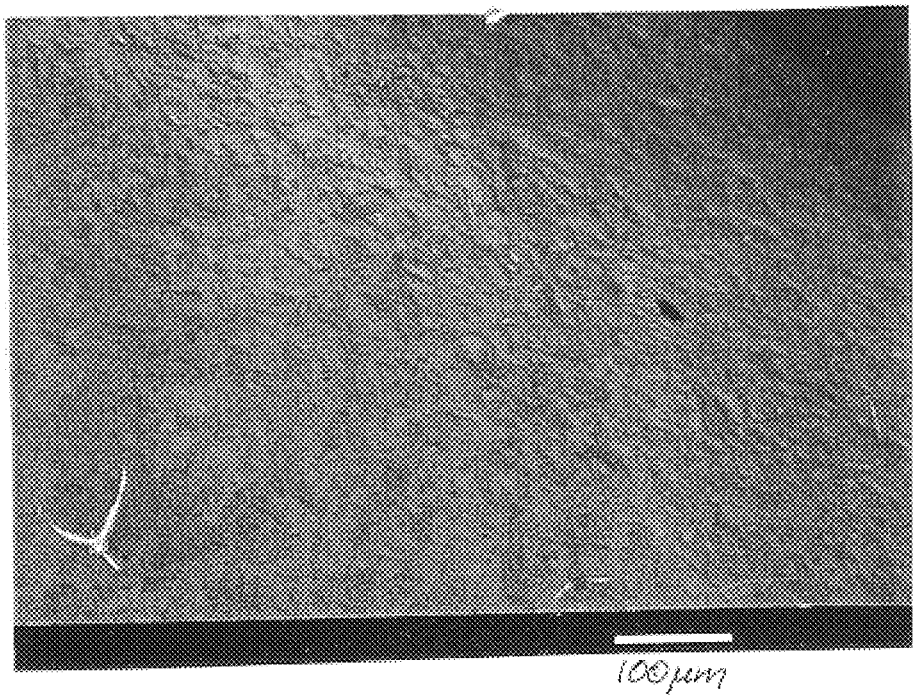
FIG. 1 shows in 150× the surface structure of the coating of cemented carbide insert coated with the method of the present invention.
Figure 2:
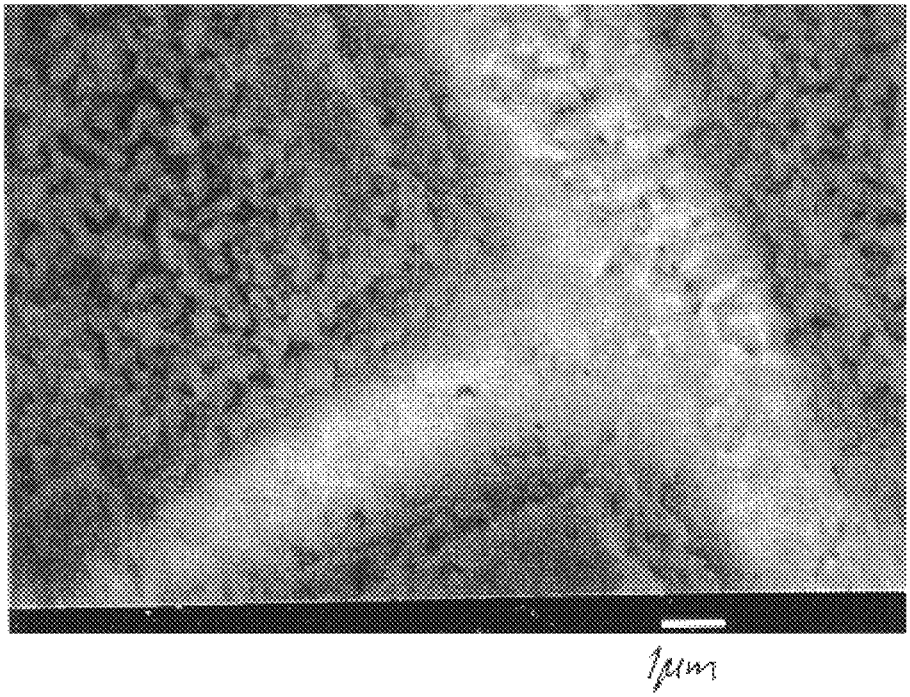
FIG. 2 shows in 1250× the microstructure and the thickness of the coating from the cross section of a T-shape crack in the coating. The network of the coating is observed clearly. The crack has been formed during the cooling step because of difference in thermal expansion coefficient between coating and cemented carbide.

It has now surprisingly been found that using a technique related to the SOL-GEL technique, cemented carbide inserts can be provided with a cobalt layer with improved bond to the tool.

According to the method of the present invention one or more metal salts of at least one iron group metal containing organic groups are dissolved and complex bound in at least one polar solvent with at least one complex former comprising functional groups in the form of OH or $NR_3$, (R=H or alkyl). Optionally, a soluble carbon source is added to the solution which is applied onto the cemented carbide inserts. The solvent is evaporated and the coated inserts are heat treated in an inert and/or reducing atmosphere. As a result, coated cemented carbide inserts are obtained which can be brazed to a tool according to standard practice.

The process according to the invention comprises the following steps where Me=Co, Ni and/or Fe, preferably Co:

1. At least one Me-salt containing organic groups such as carbo-oxylates, acetyl-acetonates, nitrogen containing organic groups such as Schiff bases, preferably Me-acetates, is dissolved in at least one polar solvent such as ethanol, acetonitrile, dimetyl-formamide or dimethyl-sulfoxide and combinations of solvent such as methanol-ethanol and water-glycol, preferably methanol. Triethanolamine or other complex former, especially molecules containing more than two functional groups, i.e., OH or $NR_3$ with R=H or alkyl(0.1–2.0 mole complex former/mole metal, preferably about 0.5 mole complex former/mole metal) is added under stirring.

2. Optionally, sugar ($C_{12}H_{22}O_{11}$) or other soluble carbon source such as other types of carbohydrates and/or organic compounds which decompose under formation of carbon in the temperature range 100–500° C. in non-oxidizing atmosphere is added(0.1–2.0 mole C/mole metal, preferably about 0.5 mole C/mole metal), and the solution is heated to 40° C. in order to improve the solubility of the carbon source. The carbon is used to reduce the MeO formed in connection with heat treatment and to regulate the carbon-content in the coating layer.

3. The solution is applied at least onto the surface/surfaces to be brazed by dipping into the solution or by spraying or painting with the solution.

4. The coated inserts obtained in the preceding step are heat treated in nitrogen at about 700–1100° C. To achieve a full reduction, a holding temperature might be needed. The time of reduction (5–120 minutes) is influenced by process factors such as coating thickness and reduction temperature. Nitrogen is normally used but argon, hydrogen, $NH_3$, CO and $CO_2$ (or mixtures between them) can be used whereby the composition and micro-structure of the coating can be modulated.

5. As a result of the heat treatment, cemented carbide inserts coated with Me are obtained which, e.g., can be brazed to a tool in the conventional way, however, with improved strength of the brazed joint.

The thickness of the final coating can be varied by varying the thickness of the initial coating. For brazing purposes a thickness of 0.1–0.5 $\mu$m is suitable. For other purposes, however, the coating can be thicker.

Because of the difference in thermal expansion, the coating generally shows cracks. These cracks however, do not affect the brazing properties of the coating.

The method according to this invention can be used to provide coatings also on Ti-based carbonitrides the so-called cermets, binderless carbide and ceramics.

In these applications the coating can be tailor-made to form a good wetting to the base material. In addition to or instead of the carbon source mentioned above, e.g., Ti can be added as soluble salt in the metal salt-solution to form a good adhesion to a Ti containing base material.

Most of the solvent can be recovered which is of great importance on an industrial production scale.

The invention is additionally illustrated in connection with the following Examples which are to be considered as illustrative of the present invention. It should be understood, however, that the invention is not limited to the specific details of the Examples.

EXAMPLE 1

134.89 g cobalt acetate-tetrahydrate ($Co(C_2H_3O_2)_2.4H_2O$) was dissolved in 800 ml methanol($CH_3OH$). 36.1 ml triethanol-amine ($(C_2H_5O)_3N$ (0.5 mole TEA/mole Co) was added during stirring and after that 7.724 g sugar (0.5 mole C/mole Co) was added. The solution was heated to about 40° C. in order to dissolve all the sugar added. About 100 cemented carbide, grade SANDVIK DC03, saw tooth inserts were dipped into the solution and dried in a drying cabinet at a temperature of about 70° C.

The inserts were placed onto net trays and heat treated in a furnace with nitrogen atmosphere. The heating rate was 10° C./min to 700° C., no holding temperature, cooling 10° C./min and finally completed with reduction in hydrogen, holding temperature 800° C. for 90 minutes.

As a result the cemented carbide inserts had been coated with a 0.3 $\mu$m coating of cobalt.

EXAMPLE 2

The inserts from Example 1 were brazed onto a saw blade according to the following:

| | |
|---|---|
| Steel | DIN75Cr1 |
| Brazing material | Degussa 49 Cu |
| Flux | Degussa Special H |
| Brazing temperature | 690° C. |

As a reference, a saw blade was manufactured using the same materials, but the inserts had been coated with cobalt in the conventional way, i.e. by electrochemical deposition. The strength of the brazing joint was determined on both saw blades by pushing off the inserts in a compression tester, using a special fixture to support the steel blade in the interface between the brazing joint and the steel. The force needed to remove (push off) the inserts was measured with the following results:

| | Conventional coating | Coating acc. to the invention |
|---|---|---|
| Number of inserts | 100 | 100 |
| Force N per $mm^2$, mean | 246 | 287 |
| standard dev | 19 | 11 |

The inserts according to the invention show both higher mean value and lower spread in the force required to remove them than the inserts coated in the conventional way.

The principles, preferred embodiments and modes of operation of the present invention have been described in the foregoing specification. The invention which is intended to be protected herein, however, is not to be construed as limited to the particular forms disclosed, since these are to be regarded as illustrative rather than restrictive. Variations and changes may be made by those skilled in the art without departing from the spirit of the invention.

We claim:

1. Method of coating metal composite cutting tool insert bodies, said bodies comprising metal carbides, nitrides, or carbonitrides, said bodies further comprising a binder phase of Co and/or Ni, at least partly with a layer of at least one iron group metal comprising the following steps:

dissolving and complex binding at least one salt of at least one iron group metal containing organic groups in at least one polar solvent with at least one complex former comprising functional groups of OH or $NR_3$, where R=H or alkyl;

applying the solution at least partly on said cutting tool insert bodies;

drying the bodies to evaporate the solvent; and heat treating the dried bodies in an atmosphere, which at least partially reduces the bodies to obtain said bodies at least partly coated with said at least one iron group metal.

2. The method of claim 1 wherein the iron group metal is Co.

3. The method of claim 1, wherein the organic groups are chosen from the group consisting of: carbo-oxylates, acetylacetonates, and nitrogen-containing groups.

4. The method of claim 3, wherein the nitrogen-containing groups comprise Schiff bases.

5. The method of claim 1, wherein the organic groups comprise an acetate.

6. The method of claim 1, wherein the polar solvent is non-aqueous.

7. The method of claim 1, wherein the polar solvent is chosen from the group consisting of: ethanol, acetonitrile, dimethyl-formamide, dimethyl-sulfoxide, methanol-ethanol, water-glycol, and methanol.

8. The method of claim 1, wherein the polar solvent comprises methanol.

9. The method of claim 1, wherein the complex former comprises triethanolamine.

10. The method of claim 1, wherein the proportion of complex former present in the solution is 0.1–2.0 mole complex former/1 mole of metal.

11. The method of claim 1, wherein the proportion of complex former present in the solution is about 0.5 mole complex former/1 mole of metal.

12. The method of claim 1, further comprising adding a soluble carbon source to the solution.

13. The method of claim 12, wherein the carbon source comprises a carbohydrate.

14. The method of claim 13, wherein the carbohydrate comprises $C_{12}H_{22}O_{11}$.

15. The method of claim 12, wherein the carbon source decomposes at a temperature of 100–500° C. in a non-oxidizing atmosphere.

16. The method of claim 12, wherein the amount of carbon from the soluble carbon source present in the solution is 0.1–2.0 mole C/1 mole metal.

17. The method of claim 12, wherein the amount of carbon from the soluble carbon source present in the solution is about 0.5 mole C/1 mole metal.

18. The method of claim 12, further comprises heating the solution to about 40° C. in order to improve the solubility of the carbon source.

19. The method of claim 1, wherein the heat treatment is conducted at 700°–1100° C.

20. The method of claim 19, wherein the reducing atmosphere contains a compound chosen from the group consisting of: nitrogen, argon, hydrogen, $NH_3$, CO, $CO_2$, and mixtures thereof.

21. The method of claim 1, further comprising adding a soluble Ti salt to the solution.

22. The method of claim 12, further comprising adding a soluble Ti salt to the solution.

23. A method of coating a metal composite cutting tool insert body, the method comprising the steps of:

a) forming a solution by dissolving and complex binding: (i) least one salt of at least one iron group metal containing organic groups, (ii) at least one polar solvent, and (iii) at least one complex former comprising functional groups of OH or $NR_3$, where R=H or alkyl;

b) adding a soluble carbon source to the solution;

c) dissolving the carbon source in the solution;

d) covering the cutting tool insert body with the solution;

e) drying the body to evaporate the solvent; and f) heat treating the dried body in a reducing atmosphere to obtain said body coated with said at least one iron group metal.

24. The method of claim 23, wherein the organic groups are chosen from the group consisting of: carbo-oxylates, acetyl-acetonates, and nitrogen-containing groups.

25. The method of claim 24, wherein the nitrogen-containing groups comprise Schiff bases.

26. The method of claim 23, wherein the organic groups comprise an acetate.

27. The method of claim 23, wherein the polar solvent is non-aqueous.

28. The method of claim 23, wherein the polar solvent is chosen from the group consisting of: ethanol, acetonitrile, dimethyl-formamide, dimethyl-sulfoxide, methanol-ethanol, water-glycol, and methanol.

29. The method of claim 23, wherein the polar solvent comprises methanol.

30. The method of claim 23, wherein the complex former comprises triethanolamine.

31. The method of claim 23, wherein the proportion of complex former present in the solution is 0.1–2.0 mole complex former/1 mole of metal.

32. The method of claim 23, wherein the proportion of complex former present in the solution is about 0.5 mole complex former/1 mole of metal.

33. The method of claim 23, wherein the carbon source comprises a carbohydrate.

34. The method of claim 33, wherein the carbohydrate comprises $C_{12}H_{22}O_{11}$ .

35. The method of claim 23, wherein the carbon source decomposes at a temperature of 100–500° C. in a non-oxidizing atmosphere.

36. The method of claim 23, wherein the amount of carbon from the soluble carbon source present in the solution is 0.1–2.0 mole C/1 mole metal.

37. The method of claim 23, wherein the amount of carbon from the soluble carbon source present in the solution is about 0.5 mole C/1 mole metal.

38. The method of claim 23, further comprises heating the solution to about 40° C. in order to improve the solubility of the carbon source.

39. The method of claim 23, wherein the heat treatment is conducted at 700°–1100° C.

40. The method of claim 39, wherein the reducing atmosphere contains a compound chosen from the group consisting of: nitrogen, argon, hydrogen, $NH_3$, CO, $CO_2$, and mixtures thereof.

41. The method of claim 23, further comprising adding a soluble Ti salt to the solution.

* * * * *